US011236509B2

(12) United States Patent
Kerns

(10) Patent No.: US 11,236,509 B2
(45) Date of Patent: Feb. 1, 2022

(54) PERMANENT TRUSS TIE

(71) Applicant: Steve Kerns, Coeur D Alene, ID (US)

(72) Inventor: Steve Kerns, Coeur D Alene, ID (US)

( * ) Notice: Subject to any disclaimer, the term of this patent is extended or adjusted under 35 U.S.C. 154(b) by 0 days.

(21) Appl. No.: 16/862,074

(22) Filed: Apr. 29, 2020

(65) Prior Publication Data

US 2020/0399900 A1 Dec. 24, 2020

Related U.S. Application Data

(60) Provisional application No. 62/863,035, filed on Jun. 18, 2019.

(51) Int. Cl.

| | |
|---|---|
| ***E04C 5/18*** | (2006.01) |
| ***E04B 7/08*** | (2006.01) |
| ***E04B 1/26*** | (2006.01) |
| ***E04C 5/16*** | (2006.01) |

(52) U.S. Cl.

CPC ..... *E04C 5/18* (2013.01); *E04B 1/2604* (2013.01); *E04B 7/08* (2013.01); *E04B 2001/2644* (2013.01); *E04C 5/163* (2013.01)

(58) Field of Classification Search

CPC ..... E04C 5/18; E04C 2003/026; E04C 5/163; E04B 1/2604; E04B 1/2608; E04B 2001/2644; E04B 7/024; E04B 7/022; E04B 7/02; E04B 7/08

See application file for complete search history.

(56) References Cited

U.S. PATENT DOCUMENTS

| | | | | |
|---|---|---|---|---|
| D293,416 | S | 12/1987 | Drueger | |
| D318,785 | S | 8/1991 | Dean | |
| 5,593,115 | A * | 1/1997 | Lewis | F16L 3/227 248/68.1 |
| 6,393,794 | B1 * | 5/2002 | Pellock | E04B 7/024 52/203 |
| 6,993,882 | B2 | 2/2006 | Crawford | |
| 7,377,048 | B2 | 5/2008 | Koetter | |
| D587,099 | S * | 2/2009 | Brizendine | D8/354 |
| 7,617,612 | B2 | 11/2009 | Brizendine | |
| D702,533 | S | 4/2014 | Noturno | |
| 8,683,772 | B2 | 4/2014 | Friis | |
| 9,297,174 | B2 * | 3/2016 | Ventling | E04B 1/355 |
| 9,903,118 | B2 | 2/2018 | Ventling | |

(Continued)

FOREIGN PATENT DOCUMENTS

| | | | | |
|---|---|---|---|---|
| GB | 2033948 A * | 5/1980 | | E04B 7/024 |
| WO | WO-2008034165 A1 * | 3/2008 | | E04G 21/1891 |

*Primary Examiner* — Christine T Cajilig

(74) *Attorney, Agent, or Firm* — The Law Office of Judd M. Patton

(57) ABSTRACT

A permanent spacing beam for the rapid deployment of roofing trusses on site. Such permanent spacing beams and truss ties as described may utilize a mount end, a retention end, and an elongate portion which spans the distance between the mount end and the retention end. The mount end may have a mount slot and the retention end may have a retention slot. The mount slot and the retention slot may be configured to permanently couple and mount to a first truss timber stud and an adjacent truss timber stud used in residential and commercial roof construction. Such a configuration results in a permanent truss tie being spanned between two roofing trusses thereby creating a more robust and sturdy roof construction.

18 Claims, 6 Drawing Sheets

(56) References Cited

U.S. PATENT DOCUMENTS

| | | | | |
|---|---|---|---|---|
| 2002/0092259 | A1* | 7/2002 | Crawford | E04C 3/02 52/696 |
| 2007/0044418 | A1* | 3/2007 | Koetter | E04D 12/004 52/695 |
| 2009/0100694 | A1* | 4/2009 | Hooks | E04G 21/1891 33/645 |

* cited by examiner

PERMANENT TRUSS TIE

RELATED APPLICATIONS

This application claims the benefit of U.S. Provisional Application No. 62/863,035 filed Jun. 18, 2019, the contents of which are incorporated by this reference in their entireties for all purposes as if fully set forth herein.

TECHNICAL FIELD

The disclosure herein relates generally to permanent roof truss ties and support system. More particularly, the disclosure relates to a device to facilitate the deployment of a series of roof trusses in a stable, rapid, precise, and reliable manner which results in stronger overall roof construction.

BACKGROUND

Roof trusses, or engineered roof systems, are an essential part of any wood frame residential or commercial building project involving pitched roof designs. Roof trusses provide the structural framework necessary to support the weight and pitch of a roof. Roof trusses come in a variety of construction designs, but all carry the same essential requirement of substantially even spacing between adjacent trusses. Such spacing is required for later construction stages where the roof will be sheeted with plywood or other sheeting material.

Modern-day roof trusses are identified by two primary portions of a truss, the chords, and the webs. Chords form the larger outline shape of the roof truss, with the web working to support the chords from the interior of the truss. Of the chords, there are top chords and bottom chords. The top chords form the pitch of the roof and will tie to the roof sheeting material. The bottom chords form the lower span on the bottom of the truss and will tie into the top plate of a wall. Commonly, the tie in point of the roof truss and the wall will constitute a bearing point and they are generally located to the outer edge of the truss.

A variety of methods may be employed to install roof trusses and ensure proper placement of the truss which ensures adequate support of the roof. Common methods of installation include spacing blocks or measurement layouts. Blocks are nailed to the prior installed truss which is pre-cut to aid in ensuring that proper spacing is maintained as each subsequent truss is tipped upright and nailed into place, said method is labor-intensive. Alternatively, measurement layouts require a worker to physically mark the top plate of a wall with a tape measure and markers which are prone to error.

Accordingly, truss installation can be dangerous since access to the truss by workers is limited, the working area tends to be well above ground level, and the trusses are heavy and awkward to move. The trusses may move or even fall while being manipulated by the workers. Because of the associated danger, getting even and substantially precise spacing between rafter segments can be challenging. To achieve precision placement of trusses during construction, workers commonly place themselves in danger trying to reach a more desirable working vantage point.

What is needed is a spacing system that eliminates the need for spacing blocks or other truss installation methods, is inexpensive to use, and is designed to ensure precise spacing between each truss. Such a truss tie would reduce hazards posed to construction workers installing the roof trusses and would be simple to install and manufacture thereby passing cost savings from reduced installation and manufacturing times onto the consumers.

SUMMARY

This disclosure herein may relate to the use of a permanent spacing beam for the rapid deployment of roofing trusses on-site. Such permanent spacing beams and truss ties may further be described as having a mount end, a retention end, and an elongate portion which spans the distance between the mount end and the retention end. The mount end may have a mount slot, a mount member, and a support flange. Accordingly, the support flange may be folded laterally with respect to the elongate portion and the mount member may additionally be folded vertically with respect to the elongate portion. The mount slot may be additionally be defined as being disposed between the mount member and the support flange. The mount slot may be configured to permanently mount to a first truss member stud.

The retention end may have a retention slot, a guide flange, and a stop flange. The guide flange may further have a leading edge and a back stop edge. The retention slot may additionally be defined as being disposed between the stop flange and the back stop edge. The retention slot may be further configured to permanently couple with an adjacent truss member stud with the leading edge configured to guide a portion of the adjacent truss member into the retention slot.

The mount end may further have a plurality of first retention apertures and the retention end may further have a plurality of second retention apertures. The permanent spacing beam may be constructed from any plastic or any metal. The permanent spacing beam may be configured for permanent installation in home construction and under a roof sheet material. The elongate member, the retention end, and the mount end may further comprise a plurality of utility apertures which may be configured for the attachment of utilities to the permanent spacing beam and under a roof sheet material.

The distance between the mount slot and the retention slot may be configured so that conventional on center framing can be maintained for 16 inches and 24 inches of truss spacing.

BRIEF DESCRIPTION OF THE DRAWINGS

Further advantages of the present invention may become apparent to those skilled in the art with the benefit of the following detailed description of the preferred embodiments and upon reference to the accompanying drawings in which:

FIG. 4 is a diagrammatic illustration of one potential action of a retaining end of a permanent spacer beam as installation may unfold;

DETAILED DESCRIPTION

Figure 1:
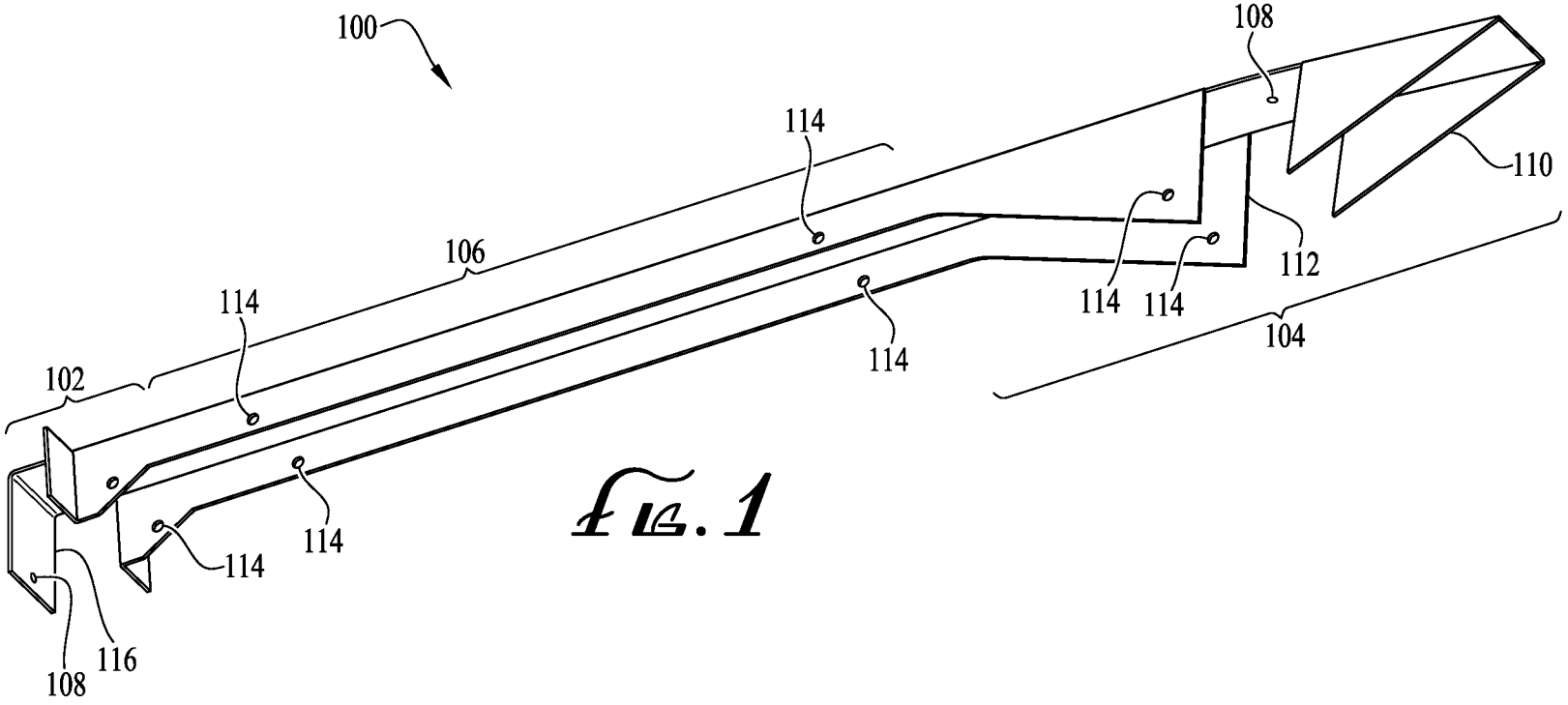
FIG. 1 is a perspective view of a permanent spacer beam.

Referring now to the drawings, like reference numerals designate identical or corresponding features throughout the several views. Further, described herein are certain non-limiting embodiments of a permanent spacer beam 100 for installation with trusses 200.

Referring to FIG. 1, illustrated is a permanent spacer beam 100 which may be ready to be utilized in the construction of a house or other building wherein a multitude of trusses may be modernly comprised of wood. Relevant portions of permanent spacer beam 100 include a mount end 102 and a retention end 104. Between mount end 102 and retention end 104 is an elongate portion 106 (also referred to as a spacing portion). Mount end 102 may be pre-mounted onto a first truss timber stud 200 (shown in FIG. 4) or member thereof prior to a first truss timber stud 200 (seen in FIG. 4) being lifted and set in place. As the first truss timber stud 200 is lifted and set into place, retention end 104 may resiliently bias onto an adjacent truss timber stud 201. (Such connection points may be to any and all sub-portions of a first truss timber stud 200 or to any and all sub-portions of an adjacent truss timber stud 201.) Elongate portion 106 may be of any desired length, preferably a length which is commonly desired for proper spacing between trusses 200 (seen in FIG. 5) but may vary considerably based on the desires of the customer, architect, or builder. Elongate portion 106 may establish and maintain a predetermined distance between trusses 200 (shown in FIG. 5).

Figure 2:
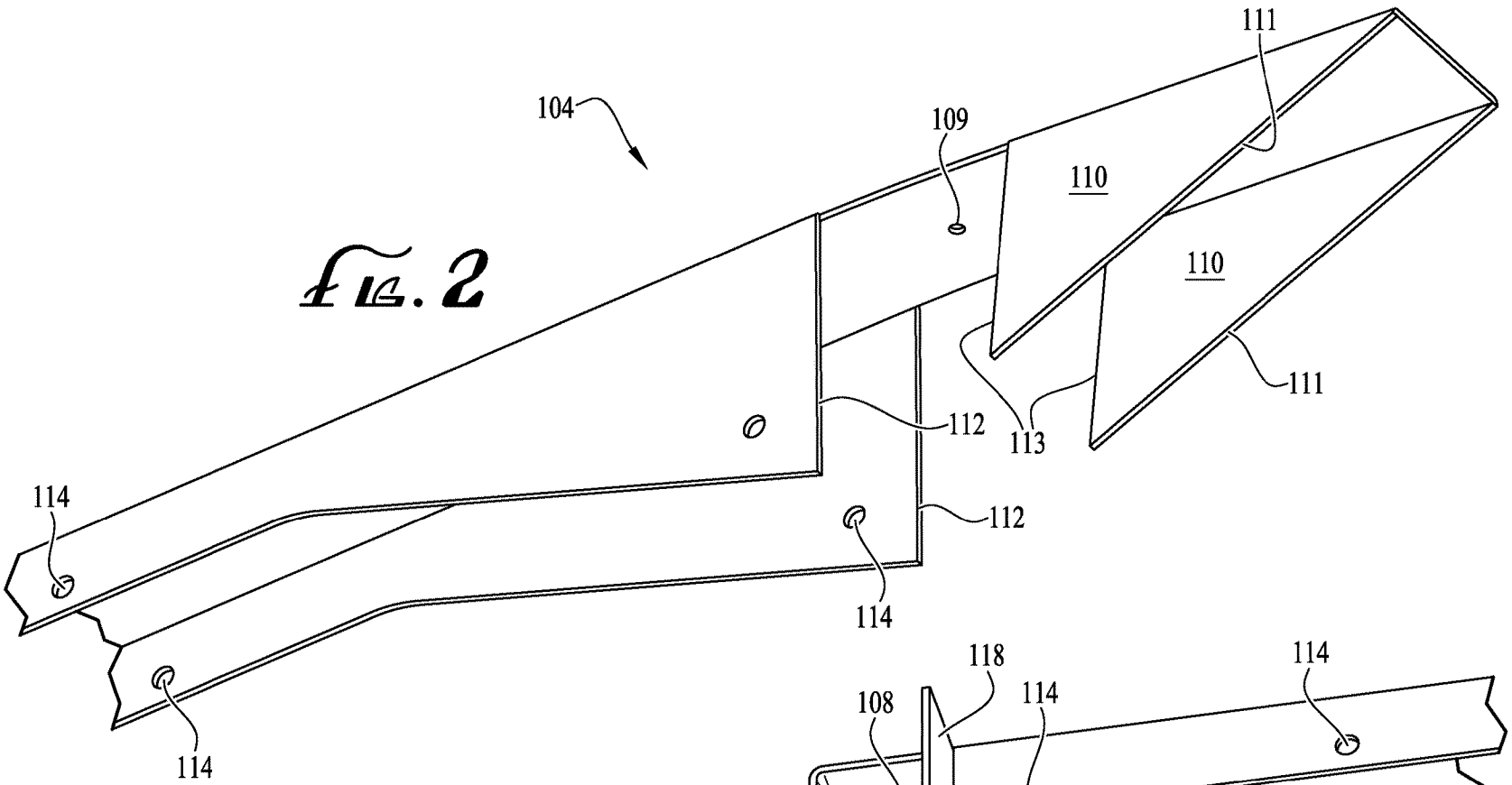
FIG. 2 is a perspective view of a retention end of a permanent spacer beam.

Referring to FIG. 2, shown is an enlarged view of retention end 104. Relevant portions of retention end 104 include a second retention aperture 109, a guide flange 110, a leading edge 111, a stop flange 112, and a multiplicity of utility apertures 114. Permanent spacer beam 100 may include a multiplicity of first retention apertures 108 and second retention apertures 109. Guide flange 110 and stop flange 112 may be in duplicate or multiplicity. Guide flange 110 may be angularly shaped such that a leading edge 111 is formed. The retention end 104 of permanent spacer beam 100 may be guided over and onto an adjacent truss timber stud 201 by applying the leading edge 111 to an adjacent truss timber stud 201 (seen in FIG. 4). Said shape may be triangular, arched, parabolic, or other shapes suitable for guiding retention end 104 over and onto an adjacent truss timber stud 201. Stop flange 112 may be utilized to halt the forward movement of permanent spacer beam 100 when a truss 200 (further shown in FIG. 4) is hoisted up and positioned in place. Stop flange 112 may be in duplicity or multiplicity. Further, stop flange 112 may be likewise angularly shaped such that permanent spacer beam 100 may be reversed in installation direction should stop flange 112 fail to halt forward movement. Further illustrated is back stop edge 113 which may prevent the adjacent truss timber stud 201 from backing off of the engagement between the adjacent truss timber stud 201 and the stop flange 112.

Figure 3:
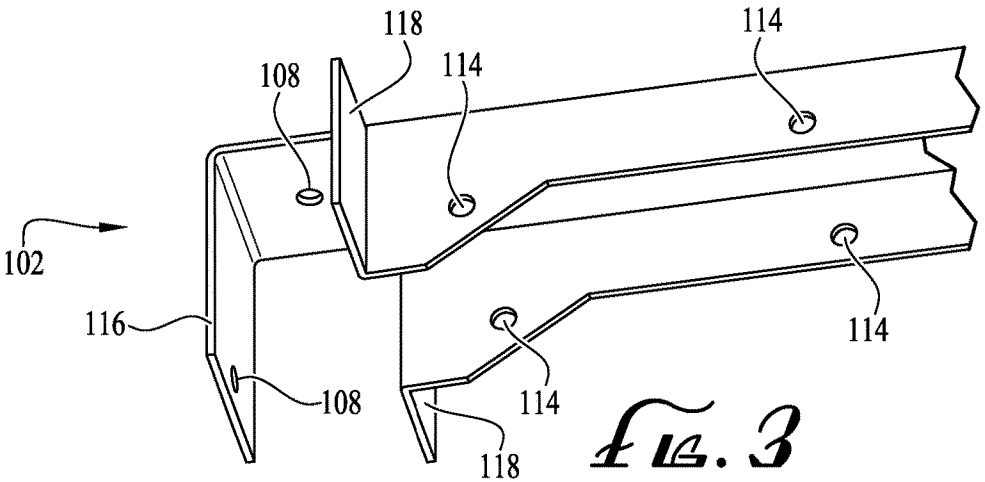
FIG. 3 is a perspective view of a mount end of a permanent spacer beam.

Referring to FIG. 3, shown in an enlarged view of mount end 102. Relevant portions of mount end 102 include retention tang 116, a multiplicity of retention apertures 108, a multiplicity of utility apertures 114, and support flange 118. Mount end 102 may have a duplicity or multiplicity of support flange 118. The support flange 118 may be utilized to maintain permanent spacer beam 100 (shown in FIG. 1) in a perpendicular jutted position relative to a presently installing truss 200 such that retention end 104 of permanent spacer beam 100 may properly engage with an adjacent truss 200 as further shown in FIG. 4. Support flange 118 may be angled laterally at 90 degrees to aid in the reduction of sway from the permanent spacer beam 100.

FIG. 4 illustrates the application of force 119 to permanent spacer beam 100 as first truss timber stud 200 is hoisted and placed into position with adjacent truss timber stud 200. Shown is mount slot 120 having been placed onto a first truss timber stud 200 which is being installed. Mount end 102 shows fasteners 122 applied to retention aperture 108 (shown in FIG. 1). Fasteners may include nails, screws, bolts, pegs, or other similar fasteners sufficient to hold permanent spacer beam 100 into place while first truss timber stud 200 is being installed and subsequently maintains connection post installation. Retention end 104 is further shown engaging with a previously installed adjacent truss timber stud 201. As can be seen, the retention slot 124 engages with the outer edge 204 and the inner edge 206 of the adjacent truss timber stud 201 such that forward and backward movement from force 119 is prohibited. As illustrated, the stop flange 112 engages with the inner edge 206 and the back stop edge 113 engages with the outer edge 204. The line marked "L" indicates a measured length. Said length may be of any length desired by a user or manufacture of the permanent spacer beam 100, for example, 16 inches or 24 inches on center.

Retention end 104 may flex over previously installed adjacent truss timber stud 201 or member thereof such that retention slot 124 may engage with adjacent truss 200 as previously described. To aid in this engagement, stop flange 112 may extend, in a downward direction relative to the installation of truss 200, past extension of guide flange 112 such that an edge of stop flange 112 may catch truss 200 during installation. Mount slot 120 and retention slot 124 may be gapped such that permanent spacer beam 100 may engage with lumber commonly sized by standard measures known in the construction industry, for example, lumber measuring in cross-section of approximately 1.5×3.5-inches known as "2×4" or approximately measuring about 1.5×5.5-inches known as 2"×6" or other standard size such as 3.5-inches×3.5-inches also known as 4" by 4". Retention slot 124 may be defined as being a space between stop flange 112 and back stop edge 113. Mount slot 120 may be defined as being a space between retention tang 116 and support flange 118 (shown in FIG. 3).

Figure 5:
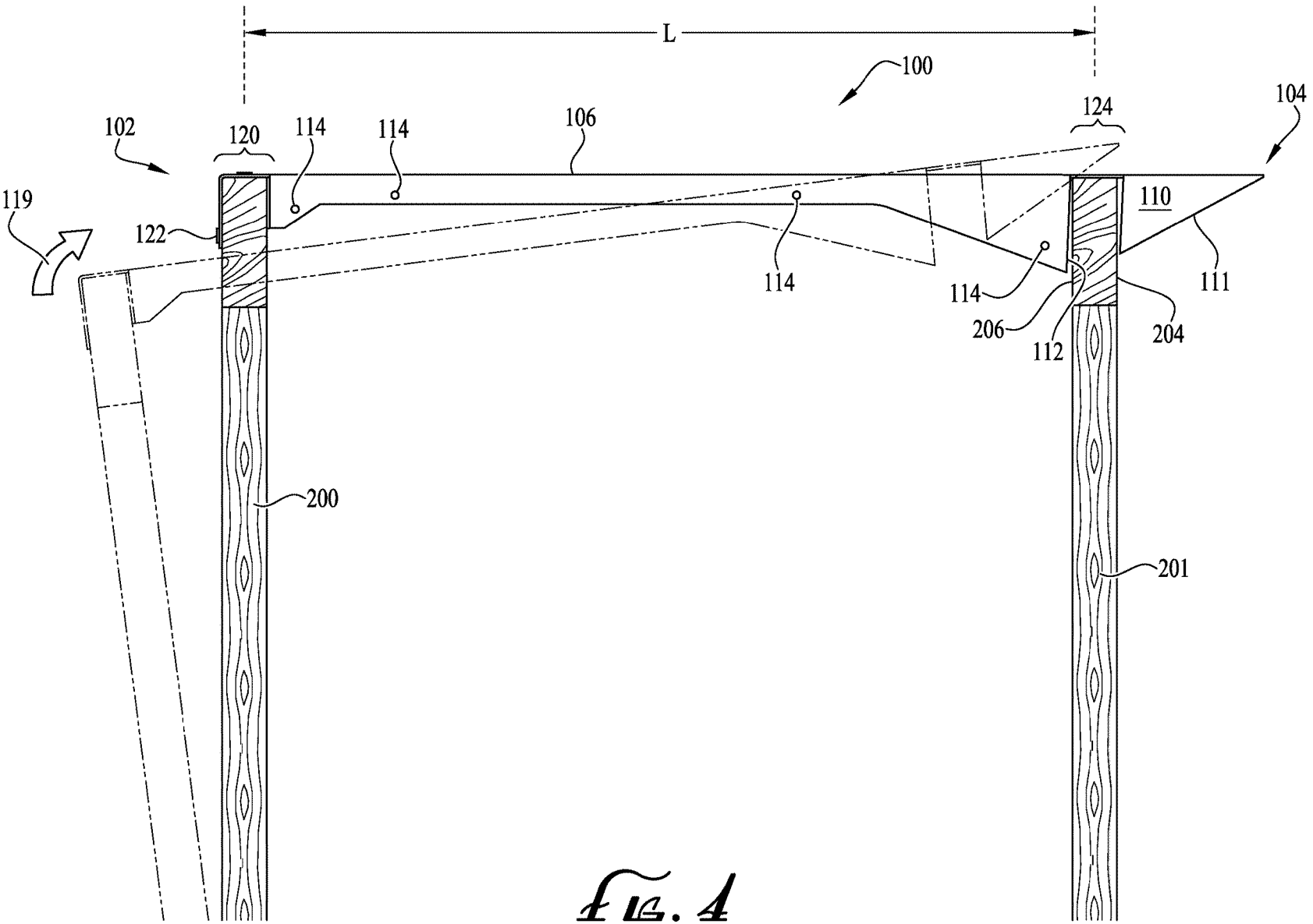
FIG. 5 is a schematic illustration of one potential installation plan of a multiplicity of trusses and permanent spacer beams.
Figure 5:
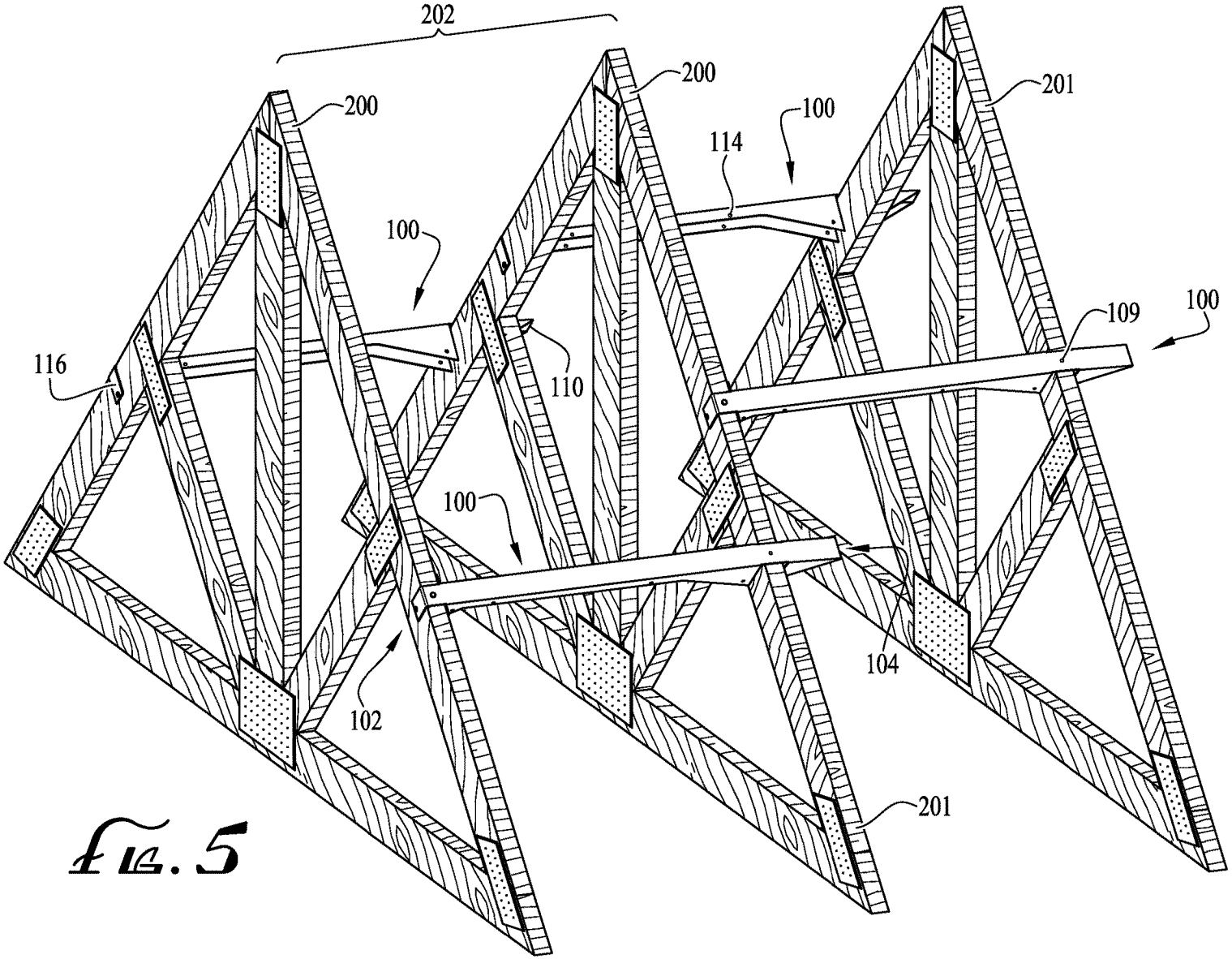

FIG. 5 illustrates the application of permanent spacer beam 100 as it may be viewed installed with a series of first truss timber studs 200 and adjacent truss timber studs 201. As can be noted, a first truss timber stud 200 can become an adjacent truss timber stud 201 as the installation of trusses proceeds. Truss spacing 202 between trusses 200 may be easily achieved by the application of permanent spacer beam 100 to a first truss timber stud 200 and an adjacent truss timber stud 201. The length of permanent spacer beam 100 may be highly controlled during the manufacturing process, such that truss spacing 202 may be of any distance necessary to proper construction engineering requirements, for example, 16 inches or 24 inches on center.

Figure 6:
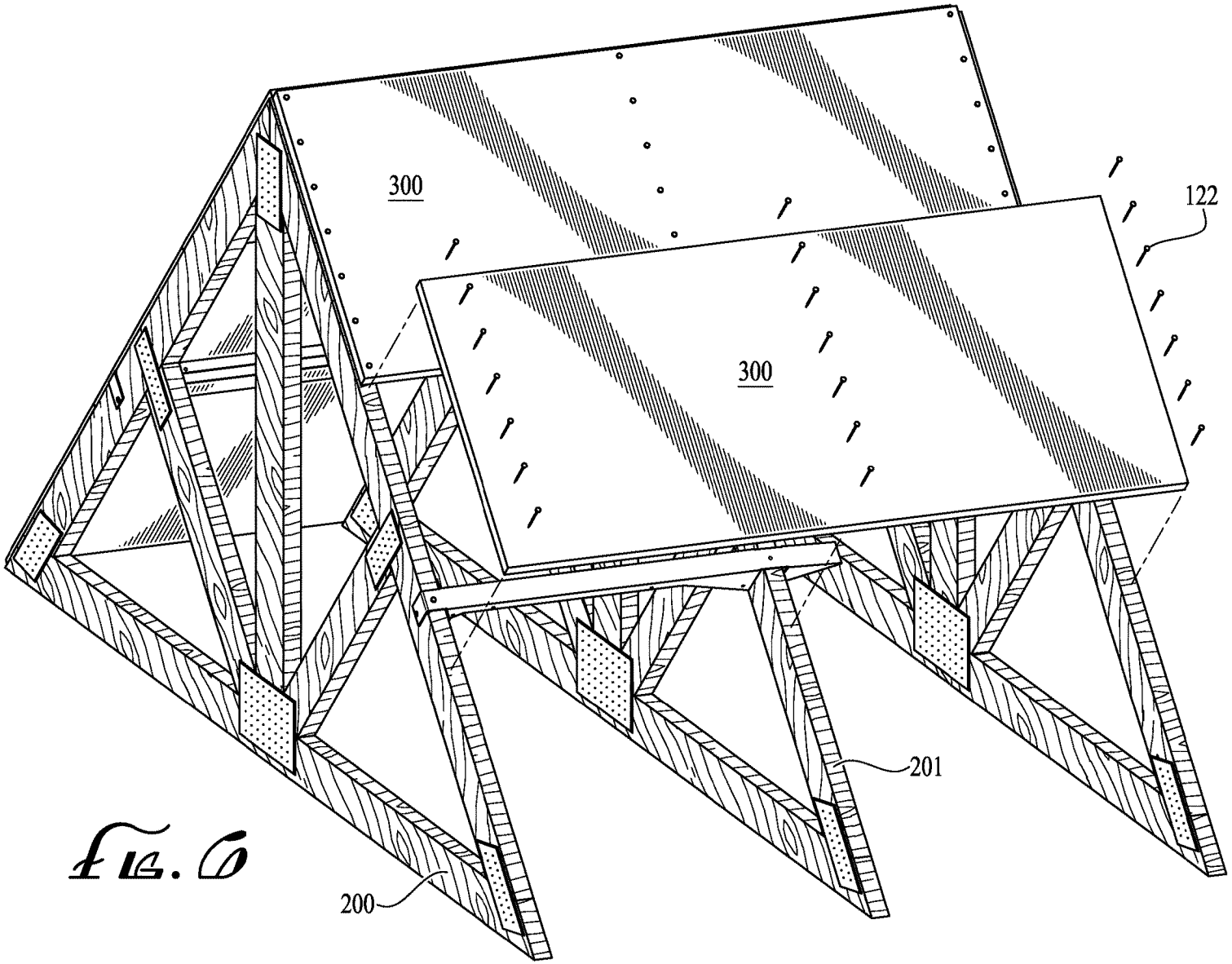
FIG. 6 is a schematic illustration of one potential installation plan of a multiplicity of trusses and permanent spacer beams as may unfold during roof sheeting; and, FIG. 7 is a schematic illustration of one potential installation plan of a multiplicity of trusses and permanent spacer beams as it may appear when roof sheeting is complete and additional utilities are installed.

FIG. 6 illustrates that the permanent spacer beam 100 may be installed on a truss, and then subsequently sheeted over by roof sheet material 300. Fastener 122 may be applied to the roofing materials in a manner commonly known and used in the art of home and commercial roofing construction.

Figure 7:
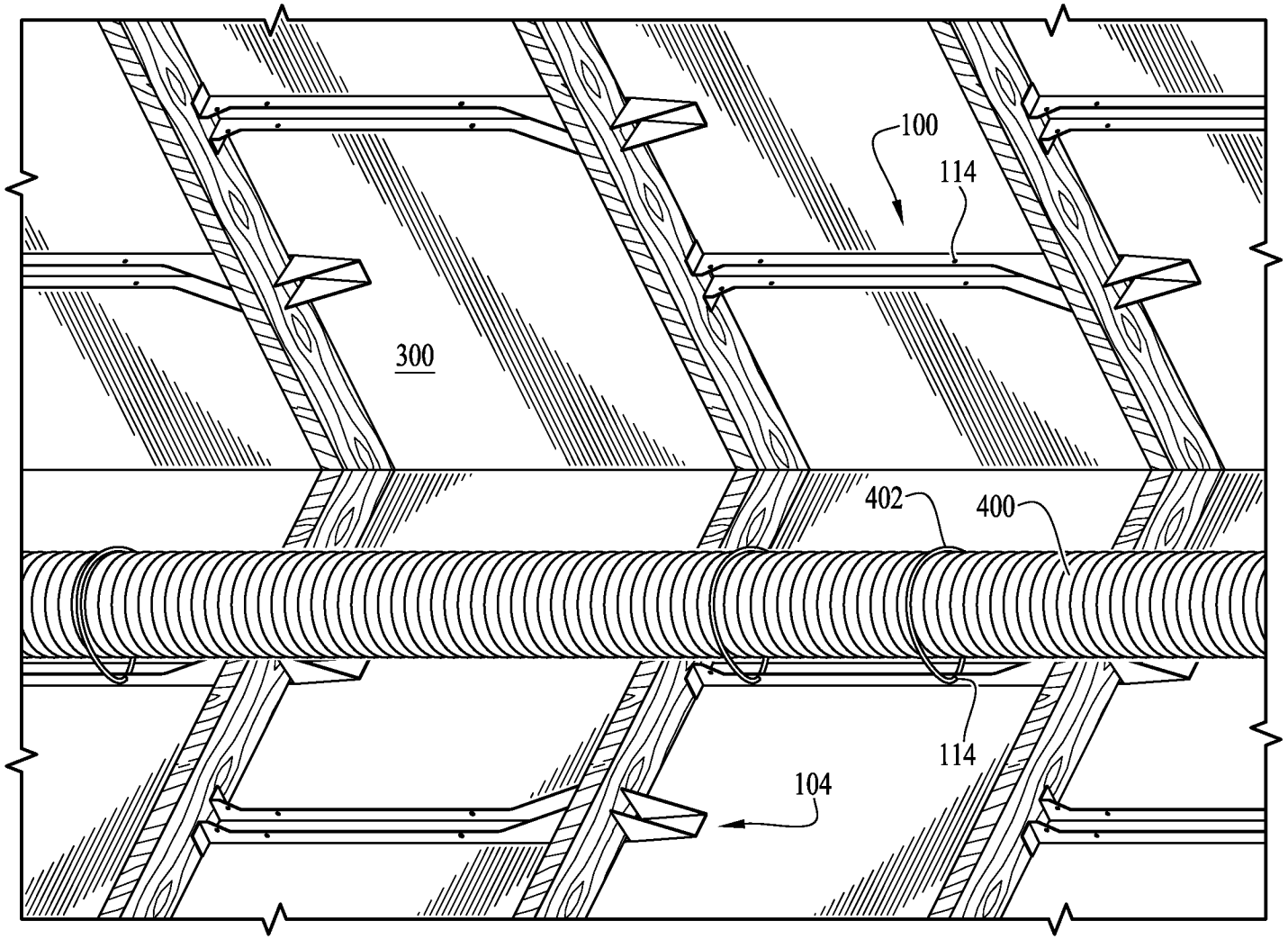

FIG. 7 illustrates how the permanent spacer beam 100 may be used by other aspects of home builders after the roof sheet material 300 has been applied. The utility apertures 114 make for convenient locations for personnel installing other essential utilities in a home to hang other material from. Shown is that of duct 400 for an HVAC system. The use of a tie 402 can be applied to a wide array of other utilities, including but not limited to, electric, cable, high-speed internet, and ducts for hot and cold air.

Having disclosed the structure of the preferred embodiments, it is now possible to describe its function, operation, and use. Permanent spacer beam 100 may be utilized during placement of truss 200 to locate an adjacent truss 200 at a predetermined distance and to secure each subsequent truss 200 in place next to each previous truss 200. In this manner, the next trust 200 is placed, located again by means of permanent spacer beam 100. Each time a truss 200 has been located by permanent spacer beam 100, the permanent spacer beam 100 and truss 200 may be secured together by applying fasteners 122 through a retention aperture 108. This may save time and costs for the builder.

The permanent spacer beam 100 may be installed during construction of the roof, which is comprised of a multitude of trusses 200 at equal distances, for example, 24-inches on center. Installation of truss 200 may occur by moving truss 200 into place with permanent spacer beam 100 pre-secured to mount end 102 as depicted in FIG. 4. The truss 200 may be lifted and/or hoisted into position with permanent spacer beam 100 being perpendicular to truss 200, for example, cross-wise to the direction of the trusses 200 to be placed as illustrated in FIG. 5. Measurements, use of spacing blocks, and marking of truss 200 locations may be eliminated. A multiplicity of truss ties 100 may be installed. Mount end 102 and retention end 104 may be fixed and fastened by fastener 122, such as screw or nail, at retention aperture 108 of the permanent spacer beam 100 as depicted in FIG. 5. The distance between trusses is fixedly determined by the distance between mount slot 120 and retention slot 124 as shown in FIG. 4.

As a truss 200 is lifted into place next to an adjacent truss 200, guide flange 110 will engage with the previously installed, and adjacent truss 200. Guide flange 110 may guide retention end 104 up and over adjacent truss 200 and may engage with adjacent truss 200 at retention slot 124 as shown in FIG. 4. The newly installed truss 200 may be retained in position by virtue of appropriate fit of retention slot 124.

Further to guide flange 110, said guide flange 110 may form a ramp for positioning of truss 200 needing to be installed. A feature that encourages rapid and easy positioning of the adjacent truss to retention slot 124 is that guide flange 110 maintains an acute angle from the perspective of the end of mount end 102 of permanent spacer beam 100, thus, as shown in FIG. 2, guide flange 110 may be longer than taller. Therefore, when the adjacent truss 200 is being slid into position it contacts the outer portion of guide flange 110 and is directed into retention slot 124. Stop flange 112 may further have a similarly acute angle relative to the perspective of mount end 102. The angular shape of guide flange 110 and stop flange 112 may ensure that permanent spacer beam 100 may be flexed appropriately in either installation direction until engagement occurs with retention slot 124 as shown in FIG. 4.

Stop flange 112 may further aid in ensuring that permanent spacer beam 100 does not move beyond adjacent truss 200 by way of having a height greater than that of guide flange 110. As illustrated in FIG. 4, stop flange 112 projects farther in a downward direction toward ground than does guide flange 110. This overhang of stop flange 112 aids in halting forward movement of the presently installed truss 200, such that engagement with retention slot 124 is made easier. However, in case installers overshoot, and as mentioned, stop flange 112 may be likewise angular in shape, allowing installers to reverse installation direction to relocate retention slot 124.

Further, it should be particularly pointed out that retention slot 124 and mount slot 120 may engage with a chord of a truss 200, a web of a truss 200, or a multiplicity of chords and/or webs of the same truss 200. More than one permanent spacer beam 100 may be installed per truss 200, or a singular permanent spacer beam 100 may be installed per truss 200.

Prior to lifting truss 200 into position, permanent spacer beam 100 may be installed to retention tang 116 in mount slot 120. Specifically, mount slot 120 is defined as being a space between retention tang 116 and support flange 118. The permanent spacer beam 100 may be attached to truss 200 prior to the installation of truss 200 by way of attachment means already discussed. The attachment utilizes the retention aperture 108 for securing truss 200 to permanent spacer beam 100. Retention aperture 108 may aid to fixedly retain truss 200 in mount slot 120. Once secured, the permanent spacer beam 100 may be stable and cannot move or fall from truss 200 as installation proceeds. After installation of all necessary trusses 200 for the project, permanent spacer beam 100 may remain in place and become permanent features in the construction design.

As mentioned, an important aspect of permanent spacer beam 100 may be the ease of achieving required truss spacing 202 for builders. Because permanent spacer beam 100 may be manufactured to any length desired, any spacing may be achieved for final installation with no requirement for the builder to perform prior layout of truss positioning. For example, if a builder so desired 24" spacing on center for truss 200 layout, permanent spacer beam 100 may be manufactured such that this spacing is achieved, the same is true for any other desired spacing. Permanent spacer beam 100 may typically be manufactured by die stamping in conventional machining operations. The metal used for fabrication may be comprised of 16-gauge sheet metal, galvanized steel, or other metal which may offer sufficient strength and rigidity to retain the trusses in position and resist unwanted movement. Said metal may further offer a resilient bias along the length of permanent spacer beam 100 and specifically near mount end 102 and retention end 104 such that engagement of retention slot 124 with truss 200 may readily occur.

An additional distinguishing feature of permanent spacer beam 100 is the inclusion of optional utility apertures 114 for hanging utility lines, air conditioning lines, electric lines, internet conduit, or other applicable utility above or near the top plate of the wall and the bottom chord of the truss that is being installed. While optional, utility aperture 114 facilitates ease of construction and further minimizes the time a worker must be among the trusses and in uncomfortable and dangerous areas. As such, additional costs incurred by permanent spacer beam 100 may be compensated for with greater safety, speed of installation, and ease of constructing the roof.

The permanent spacing beam may further be described as potentially comprising a mount end 102, a retention end 104, and an elongate portion 106 which may be disposed between the mount end 102 and the retention end 104. The mount end 102 may further have a mount slot 120, a mount member 116, and a support flange 118. Accordingly, the support flange 118 may be folded laterally at a 90-degree angle with respect to the elongate portion 106 and the mount member 116 may additionally be folded vertically at a 90-degree angle with respect to the elongate portion 106. The mount slot 120 may be additionally defined as being disposed between the mount member 116 and the support flange 118. The mount slot 120 may be configured to permanently mount to a first truss member stud 200.

The retention end 104 may have a retention slot 124, a guide flange 110, and a stop flange 112, the guide flange 110 may further have a leading edge 111 and a back stop edge 113. The retention slot 124 may additionally be defined as being disposed between the stop flange 112 and the back stop edge 113. The retention slot 124 may be further configured to permanently couple with an adjacent truss member stud 201 with the leading edge 111 potentially being configured to guide a portion of the adjacent truss member 201 into the retention slot 124.

The mount end 102 may further have a plurality of first retention apertures 108 and the retention end may further have a plurality of second retention apertures 109. The permanent spacing beam 100 may be constructed from any plastic or any metal. The permanent spacing beam 100 may be configured for permanent installation in home construction and under a roof sheet material 300. The elongate member 106, the retention end 104, and the mount end 102 may further comprise a plurality of utility apertures which may be configured for the attachment of utilities 400 to the permanent spacing beam 100 and under a roof sheet material 400.

The distance between the mount slot 120 and the retention slot 124 may be configured so that conventional on center framing can be maintained for 16 inches of truss spacing 202. Alternatively, the distance between the mount slot 120 and the retention slot 124 may be configured so that conventional on center framing can be maintained for 24 inches of truss spacing 202.

Additional embodiments of a permanent spacing beam 100 may comprise a mount end 102 which may have a mount slot 120, a mount member 116 and a one or more than one support flange 118. The mount member 116 may have one or more than one first retention aperture 108. The one or more than one support flange 118 may have a lateral 90 degree angle with respect to the elongate portion 106, the mount member 116 may also have a vertical 90 degree angle with respect to the elongate portion 106.

The mount end 102 may be configured to envelop a first truss timber stud 200 in the mount slot 120 with the mount slot 120 being further defined as disposed between the mount member 116 and the one or more than one support flange 118. The one or more than one second retention aperture 109 may be configured to receive a fastener 302 such that the fastener 302 may fasten the first truss timber stud 200 to the mount slot 120.

The retention end 104 may have a retention slot 124, a one or more than one guide flange 110, a one or more than one stop flange 112, and a one or more than one second retention aperture 109. The each guide flange 110 may further have a leading edge 111 and a back stop edge 113. The retention slot 124 may be further defined as being disposed between the stop flange 112 and the back stop edge 113.

Seen in FIG. 4, the retention slot 124 may be configured to engage with an adjacent truss timber stud 201 by applying a force 119 to the first truss timber stud 200 until the leading edge 111 makes a contact with the adjacent truss timber stud 201. The contact may cause the leading edge 111 to ride over a portion of the adjacent truss timber stud 201 wherein the ride over of the portion of adjacent truss timber 201 may cause the stop flange 112 to subsequently contact the adjacent truss timber stud 201. The contact of the adjacent truss timber stud 201 with stop flange 112 may result in a halt of the force 119 applied to the first truss timber 200. The halt may thereby cause the back stop edge 113 and the stop flange 112 to simultaneously traverse down an outer edge 204 and an inner edge 206 of the adjacent truss stud 201. The one or more than one second retention aperture 109 may be configured to receive the fastener 302 such that the fastener 302 may fasten the adjacent truss timber stud 201 to the retention slot 124.

While particular forms of the invention have been illustrated and described, it will also be apparent to those skilled in the art that various modifications can be made without departing from the spirit and scope of the invention.

Accordingly, it is not intended that the invention be limited except by the appended claims. Insofar as the description above and the accompanying drawings disclose any additional subject matter that is not within the scope of the claims below, the inventions are not dedicated to the public and the right to file one or more applications to claim such additional inventions is reserved.

What is claimed is:

1. A permanent spacing beam comprising;

a mount end, a retention end, and an elongate portion disposed between the mount end and the retention end;

the mount end having a mount slot, a mount member and a support flange; the support flange being folded laterally at a 90 degree angle with respect to the elongate portion, the mount member being folded vertically at a 90 degree angle with respect to the elongate portion, the mount slot being further defined as disposed between the mount member and the support flange, said mount slot being configured to permanently mount to a first truss member stud; and, the retention end having a retention slot, a guide flange, and a stop flange, the guide flange further having a leading edge and a back stop edge, the stop flange being longer than the back stop edge of the guide flange, said retention slot being defined as disposed between the stop flange and the back stop edge, said retention slot being configured to permanently couple with an adjacent truss member stud, the leading edge configured to guide a portion of the adjacent truss member into the retention slot.

2. The permanent spacing beam of claim 1, wherein the mount end further has a plurality of first retention apertures.

3. The permanent spacing beam of claim 1, wherein the retention end further has a plurality of second retention apertures.

4. The permanent spacing beam of claim 1, wherein the permanent spacing beam is constructed from at least one of plastic or metal.

5. The permanent spacing beam of claim 1, wherein the permanent spacing beam is configured to be permanently installed in home construction and under a roof sheet material.

6. The permanent spacing beam of claim 1, wherein the elongate member, the retention end, and the mounting end further comprise a plurality of utility apertures, said utility apertures configured for the attachment of utilities to the permanent spacing beam and under a roof.

7. The permanent spacing beam of claim 1, wherein the distance between the mount slot and the retention slot is configured so that conventional on center framing can be maintained for 16 inches.

8. The permanent spacing beam of claim 1, wherein the distance between the mount slot and the retention slot is configured so that conventional on center framing can be maintained for 24 inches.

9. A permanent spacing beam comprising;

a mount end, a retention end, and an elongate portion disposed between the mount end and the retention end;

the mount end having a mount slot, a mount member and a one or more than one support flange, the mount member having a one or more than one first retention aperture, the one or more than one support flange having a lateral 90 degree angle with respect to the elongate portion, the mount member having a vertical 90 degree angle with respect to the elongate portion;

wherein the mount end is configured to envelop a first truss timber stud in the mount slot, the mount slot being further defined as disposed between the mount member and the one or more than one support flange, the one or more than one first retention aperture being configured to receive a fastener such that the fastener fastens the first truss timber stud to the mount slot;

the retention end having a retention slot, a one or more than one guide flange, a one or more than one stop flange, and a one or more than one second retention aperture, the each guide flange further having a leading edge and a back stop edge, the one or more than one stop flange extending beyond the back stop edge of the each guide flange with respect to a ground, said retention slot being further defined as disposed between the stop flange and the back stop edge;

wherein the retention slot is configured to engage with an adjacent truss timber stud, said engagement occurring by:

(a) applying a force to the first truss timber stud until the leading edge makes a contact with the adjacent truss timber stud, (b) said contact causing the leading edge to ride over a portion of the adjacent truss timber stud, (c) said ride over of the portion of adjacent truss timber stud causing the stop flange to subsequently contact the adjacent truss timber stud, (d) said contact of the adjacent truss timber stud with the stop flange thereby resulting in a halt of forward movement of the first truss timber stud, (e) said halt of forward movement thereby causing the back stop edge and the stop flange to simultaneously traverse down an outer edge and an inner edge of the adjacent truss timber stud, the one or more than one second retention aperture being configured to receive the fastener such that the fastener fastens the adjacent truss timber stud to the retention slot.

10. The permanent spacing beam of claim 9, wherein the permanent spacing beam is constructed from at least one of plastic or metal.

11. The permanent spacing beam of claim 9, wherein the permanent spacing beam is configured to be permanently installed in home construction and under a roof sheet material.

12. The permanent spacing beam of claim 9, wherein the elongate member, the retention end, and the mounting end further comprise a plurality of utility apertures, said utility apertures configured for the attachment of utilities to the permanent spacing beam and under a roof.

13. The permanent spacing beam of claim 9, wherein the distance between the mount slot and the retention slot is configured so that conventional on center framing can be maintained for 16 inches.

14. The permanent spacing beam of claim 9, wherein the distance between the mount slot and the retention slot is configured so that conventional on center framing can be maintained for 24 inches.

15. A permanent spacing beam comprising;

a mount end, a retention end, and an elongate portion disposed between the mount end and the retention end, the permanent spacing beam being configured for permanent installation in home construction;

the mount end having a mount slot, a mount member and a one or more than one support flange, the mount member having a one or more than one first retention aperture, the one or more than one support flange having a lateral 90 degree angle with respect to the elongate portion, the mount member having a vertical 90 degree angle with respect to the elongate portion;

wherein the mount end is configured to envelop a first truss timber stud in the mount slot, the mount slot being further defined as disposed between the mount member and the one or more than one support flange, the one or more than one retention aperture being configured to receive a fastener such that the fastener fastens the first truss timber stud to the mount end;

the retention end having a retention slot, a one or more than one guide flange, a one or more than one stop flange, and a one or more than one second retention aperture, each the guide flange further having a leading edge and a back stop edge, the one or more than one stop flange extending beyond the back stop edge of the each guide flange with respect to a ground, said retention slot being further defined as disposed between the stop flange and the back stop edge;

wherein the retention slot is configured to engage with an adjacent truss timber stud, said engagement occurring by applying a force to the first truss timber stud until the leading edge makes a contact with the adjacent truss timber, said contact causing the leading edge to ride over a portion of the adjacent truss timber, said ride over of the portion of adjacent truss timber causing the stop flange to subsequently contact the adjacent truss timber, said contact of the adjacent truss timber with stop flange resulting in a halt of forward movement of the first truss timber, said halt of forward movement thereby causing the back stop edge and the stop flange to simultaneously traverse down an outer edge and an inner edge of the adjacent truss stud;

wherein the distance between the mount slot and the retention slot is configured so that a conventional on center framing is maintained;

the elongate member, the retention end, and the mounting end further having a plurality of utility apertures, said utility apertures configured for the attachment of utilities to the permanent spacing beam and under a roof.

16. The permanent spacing beam of claim 15, wherein the permanent spacing beam is constructed from at least one of plastic or metal.

17. The permanent spacing beam of claim 15, wherein the conventional on center framing distance is 24 inches.

18. The permanent spacing beam of claim 15, wherein the conventional on center framing distance is 16 inches.

* * * * *